US007300124B2

(12) United States Patent
Oomura et al.

(10) Patent No.: US 7,300,124 B2
(45) Date of Patent: Nov. 27, 2007

(54) RECORDING HEAD AND RECORDING APPARATUS USING THE SAME

(75) Inventors: Masanobu Oomura, Yokohama (JP); Takashi Morii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 11/146,175

(22) Filed: Jun. 7, 2005

(65) Prior Publication Data

US 2005/0275673 A1 Dec. 15, 2005

(30) Foreign Application Priority Data

Jun. 10, 2004 (JP) ..... 2004-172532

(51) Int. Cl.
*B41J 29/38* (2006.01)

(52) U.S. Cl. ..... 347/5; 347/9; 347/12

(58) Field of Classification Search ..... 347/5, 347/9, 12, 59, 56, 57; 323/313
See application file for complete search history.

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 5,646,517 A | * | 7/1997 | Belot et al. | 323/313 |
| 6,290,334 B1 | | 9/2001 | Ishinaga et al. | 347/59 |
| 6,474,789 B1 | | 11/2002 | Ishinaga et al. | 347/59 |

FOREIGN PATENT DOCUMENTS

| | | |
|---|---|---|
| JP | 59-123670 A | 7/1984 |
| JP | 59-138416 A | 8/1984 |
| JP | 5-185594 A | 7/1993 |
| JP | 11-129479 A | 5/1999 |

* cited by examiner

*Primary Examiner*—Lam Son Nguyen
(74) *Attorney, Agent, or Firm*—Fitzpatrick, Cella, Harper & Scinto

(57) ABSTRACT

A recording head or the like having a voltage generating circuit which does not depend on a voltage fluctuation of a heater driving power source (first power source) is provided. The recording head has: a plurality of heaters connected to a power line VH as a heater driving power source; a power transistor as a switching element for independently driving each heater by supplying a current thereto; and a voltage generating circuit for supplying a voltage for a control signal for controlling the power transistor. The voltage generating circuit has a resistor R1 connected to a grounding potential and an n-type MOS transistor T1 in which a reference voltage V1 which is generated by supplying a constant current from a constant current source I0 to the resistor R1 is inputted to a gate.

6 Claims, 11 Drawing Sheets

RECORDING HEAD AND RECORDING APPARATUS USING THE SAME

BACKGROUND OF THE INVENTION

1. Field of the Invention

The invention relates to a recording head of an ink jet system for recording onto a recording medium by discharging ink and to a recording apparatus using such a recording head.

2. Related Background Art

FIG. 13 is a diagram showing a circuit construction of a recording head mounted in a recording apparatus of a conventional ink jet system. An electrothermal converting element (heater) of such a kind of recording head and its drive circuit can be formed on a same substrate by using a semiconductor processing technique as shown in, for example, U.S. Pat. No. 6,290,334 (corresponding to Japanese Patent Application Laid-Open No. H05-185594).

As shown in FIG. 13, reference numeral 101 denotes electrothermal converting elements (heaters) as recording elements each for generating heat to discharge ink; 102 n-type power transistors as switching elements each for supplying a desired current to the heater 101; and 106 a shift register for supplying a current to each heater 101 and temporarily storing image data to decide whether or not the ink is discharged from a nozzle of the recording head. A transfer clock signal input terminal (CLK) and an image data input terminal (DATA) for serially inputting image-data for turning on/off the heaters 101 are provided for the shift register 106. Reference numeral 105 denotes latch circuits each for recording and holding the image data for the heater 101 every heater. A latch signal input terminal (LT) for inputting an output of the shift register 106 and inputting a latch signal to control latch timing is provided for the latch circuit 105. Reference numeral 104 denotes AND circuits. Each AND circuit 104 inputs an output of the latch circuit 105 and a heating signal (HE) to decide timing for supplying the current to the heater 101. An output of the AND circuit 104 is inputted to a gate of the n-type power transistor 102 through a voltage conversion circuit 103.

The n-type power transistor 102 comprises, for example, a field effect transistor such as nMOS transistor, n-type DMOS (diffusion MOS), or the like.

A circuit construction of the voltage conversion circuit 103 will be described. Reference numeral 208 denotes a first inverter circuit for inverting the image data from the AND circuit 104; 207 a second inverter circuit for further inverting a signal outputted from the first inverter circuit 208; 202 a pMOS transistor; and 203 an nMOS transistor. A first CMOS inverter circuit is constructed by the pMOS transistor 202 and the nMOS transistor 203. Reference numeral 201 denotes a first pMOS transistor for buffering. In order to enable the first CMOS inverter circuit to be driven at a voltage which is equal to or less than 5V as an output voltage of the AND circuit (a power voltage of the logic unit is generally equal to or less than 5V), the first pMOS transistor 201 for buffering divides a voltage supplied from an internal power line VHTM which is outputted from a voltage generating circuit 107. Reference numeral 205 denotes a pMOS transistor and 206 indicates an nMOS transistor. A second CMOS inverter circuit is constructed by the pMOS transistor 205 and the nMOS transistor 206. Reference numeral 204 denotes a second pMOS transistor for buffering. A gate of the second pMOS transistor 204 for buffering is connected to a connecting portion of the pMOS transistor 202 and the nMOS transistor 203 as an output portion of the first CMOS inverter circuit forming a pair with the second CMOS inverter circuit. Similarly, a gate of the first pMOS transistor 201 for buffering is also connected to a connecting portion of the pMOS transistor 205 and the nMOS transistor 206 as an output portion of the second CMOS inverter circuit forming a pair with the first CMOS inverter circuit and this connecting portion also functions as an output portion of the voltage conversion circuit.

It is desirable to set the output voltage VHTM of the voltage generating circuit 107 to as high a value as possible without exceeding a breakdown withstanding voltage of the CMOS inverter and a gate withstanding voltage of the MOS. If possible, the output voltage VHTM can be made common to a power line VH of the heater. However, a driving voltage of the general heater is often set as a relatively high voltage of 20V or more and the breakdown withstanding voltage of the CMOS inverter is often formed by a process of up to about 15V. Since the gate withstanding voltage of the MOS depends on a gate oxide film, it is also necessary to set the breakdown withstanding voltage to a value lower enough than an insulative withstanding voltage the gate oxide film. Therefore, it is difficult to make the driving voltage of the heater to coincide with the optimum voltage of the voltage conversion circuit. If the power line of the voltage conversion circuit is separately provided, it results in an increase in costs of the whole system.

In the conventional technique, therefore, the voltage generating circuit 107 is realized by a circuit construction as shown in FIG. 14.

In the circuit construction as shown in FIG. 14, an arbitrary voltage is formed from the power line VH of the heater by a voltage dividing ratio of resistors R0 and R1 and inputted to a source-follower circuit constructed by an nMOS transistor T1 as a buffer and a resistor R2. A source of the nMOS transistor T1 is used as an output terminal of the voltage generating circuit 107.

FIG. 15 is a timing chart for various signals to drive the drive circuit of the recording head shown in FIG. 13. The drive circuit of the recording head shown in FIG. 13 will be described with reference to FIG. 15 and the like.

A transfer clock signal (CLK) and an image data signal (DATA) are inputted to the shift register 106. The shift register 106 operates synchronously with a leading edge of the transfer clock signal CLK. Since the number of bits of the image data (DATA) stored in the shift register 106 is equal to the number of heaters 101 and the number of power transistors 102, pulses of transfer clock signals (CLK) as many as the number of heaters 101 are inputted and the image data (DATA) is transferred to the shift register 106. Thereafter, by supplying the latch signal (LT), the image data (DATA) corresponding to each heater 101 is held in the latch circuit 105. After that, the AND of an output of the latch circuit 105 and the heat signal (HE) is calculated (AND process). A current is supplied from the power line VH to the power transistor 102 and the heater 101 for the time corresponding to the output of the AND circuit and flows in the GNDH line. At this time, the heater 101 generates heat necessary to discharge the ink, so that the ink according to the image data is discharged from the nozzle of the recording head.

The circuit construction described above has been disclosed in Japanese Patent Application Laid-Open-No. H11-129479 as a Japanese Patent Laid-Open Publication.

However, according to the above prior art, since the output voltage VHTM of the voltage generating circuit 107 is determined by the voltage dividing ratio of the resistors R0 and R1, the voltage generating circuit 107 depends largely on a fluctuation in power line to which the heater 101 is connected. There is, consequently, such a problem that when the output voltage VHTM fluctuates, a resistance (ON resistance) at the time of conduction of the power transistor changes and a desired discharging energy cannot be obtained.

When it is necessary to adjust the discharging energy, generally, the heat energy generated by the heater 101 is adjusted by changing the power voltage of the power line VH. However, if the power voltage of the power line VH is changed, since the output voltage VHTM fluctuates, such adjustment cannot be made after the recording head is manufactured. Therefore, to adjust the discharging energy, it is necessary to design the drive circuit of the recording head again and newly manufacture it. Consequently, such a problem that developing time of the recording head becomes long and its developing costs increase occurs.

The invention is made in consideration of the above problems and it is an object of the invention to provide a recording head having a voltage generating circuit which does not depend on a fluctuation in heater driving voltage (first power voltage) and a recording apparatus using such a recording head.

SUMMARY OF THE INVENTION

To accomplish the above object, according to the invention, there is provided a recording head comprising: a plurality of recording elements connected to a first power source; a switching element which is serially connected to each of the recording elements and independently drives each of the recording elements by supplying a current thereto; and a voltage generating circuit for supplying a voltage for a control signal for controlling the switching element, wherein the voltage generating circuit has a first current-voltage conversion circuit connected to a grounding potential, a first reference voltage which is generated by supplying a constant current to the first current-voltage conversion circuit or a voltage correlated to the first reference voltage is set as a control voltage, and an output voltage is determined by inputting the control voltage to a first transistor.

According to the invention, the control voltage of the first transistor becomes a voltage (first reference voltage) which does not depend on a fluctuation in the first power source and the voltage generating circuit can generate the stable voltage.

Other features and advantages of the present invention will be apparent from the following description taken in conjunction with the accompanying drawings, in which like reference characters designate the same or similar parts throughout the figures thereof.

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Embodiments of the invention will now be described with reference to the drawings. In the description, "GND potential" is not limited to a grounding potential, but may be another potential of a predetermined fixed level.

First Embodiment

Figure 1:
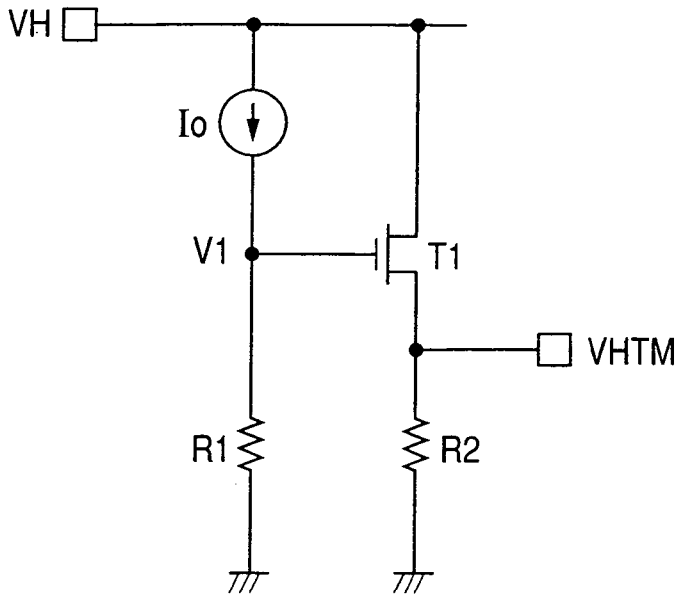
FIG. 1 is a circuit diagram showing a construction of a voltage generating circuit in a drive circuit for driving a recording head according to the first embodiment of the invention.

FIG. 1 is a circuit diagram showing a construction of a voltage generating circuit in a drive circuit for driving a recording head according to the first embodiment of the invention. Since portions other than the voltage generating circuit of the drive circuit in the recording head of the embodiment are similar to those in the prior art shown in FIG. 13, explanation of the other portions of the drive circuit is omitted.

In the voltage generating circuit in the embodiment, one terminal of the resistor R1 as a first resistance element constructing a first current-voltage conversion circuit is connected to the GND potential and a constant current source I0 is connected to the other terminal. By supplying a constant current from the constant current source I0 to the resistor R1, a voltage V1 (first reference voltage) as a control voltage generated at a connecting point of the resistor R1 and the constant current source I0 is inputted to a gate of the nMOS transistor T1 as a first transistor.

The other terminal of the constant current source I0 and a drain of the nMOS transistor T1 are connected to the power line VH as a first power source. The source of the nMOS transistor T1 is connected to one terminal of the second resistor R2 and a connecting point of both of them is an output terminal of the voltage generating circuit. The other terminal of the resistor R2 is connected to the GND potential. As an internal power line constructing the recording head, the voltage generating circuit supplies the power source VHTM to the voltage conversion circuit in a manner similar to the prior art and, further, supplies a voltage for a control signal to control the power transistor 102 (refer to FIG. 13).

If the voltage generating circuit in the embodiment is used for the recording head, the voltage V1 inputted to the gate of the transistor T1 becomes a voltage (first reference voltage generated at the connecting point of the resistor R1 and the constant current source I0) which does not depend on the fluctuation in the power line VH. Therefore, the voltage generating circuit can generate the stable voltage. Even if the power voltage of the power line VH supplied to the heater is changed, the output voltage VHTM of the voltage generating circuit does not change. Therefore, even after the recording head is formed, a heat energy generated by the heater can be adjusted. Consequently, since there is no need to newly manufacture the drive circuit of the recording head by re-designing it in order to adjust the discharging energy, the developing time of the recording head can be shortened and the developing costs can be reduced.

In the embodiment, an example in which the nMOS transistor as a field effect transistor is used as a transistor connected to the output terminal has been described. However, another npn transistor can be also used.

Second Embodiment

Figure 2:
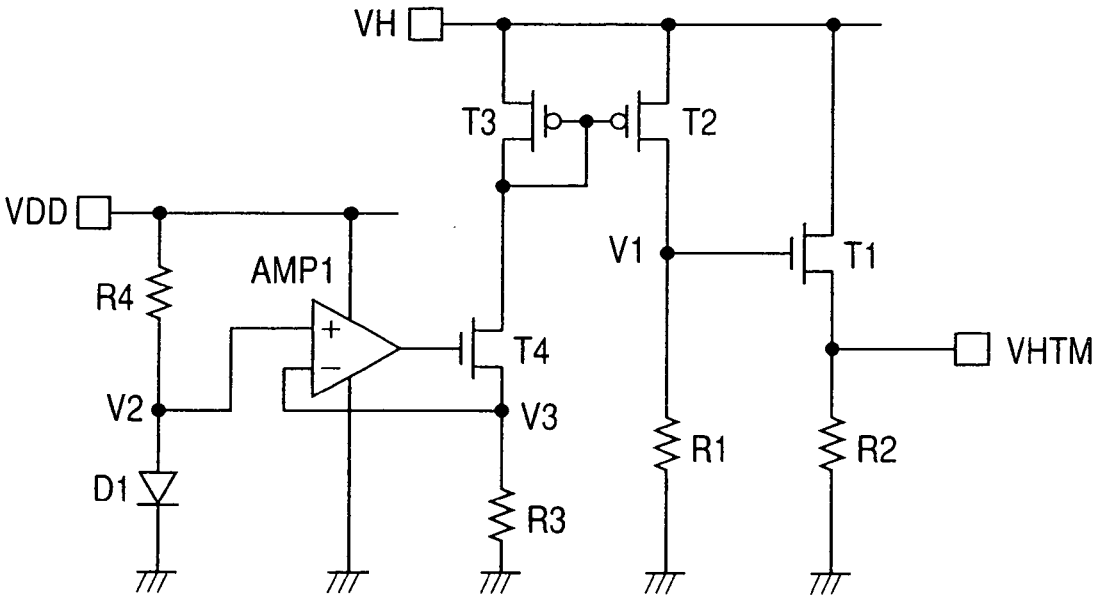
FIG. 2 is a circuit diagram showing a construction of a voltage generating circuit in a drive circuit for driving a recording head according to the second embodiment of the invention.

FIG. 2 is a circuit diagram showing a construction of a voltage generating circuit in a drive circuit for driving a recording head according to the second embodiment of the invention. Since portions other than the voltage generating circuit of the drive circuit in the recording head of the embodiment are similar to those in the prior art shown in FIG. 13 in a manner similar to the foregoing embodiment, explanation of the other portions of the drive circuit is omitted.

Figure 13:
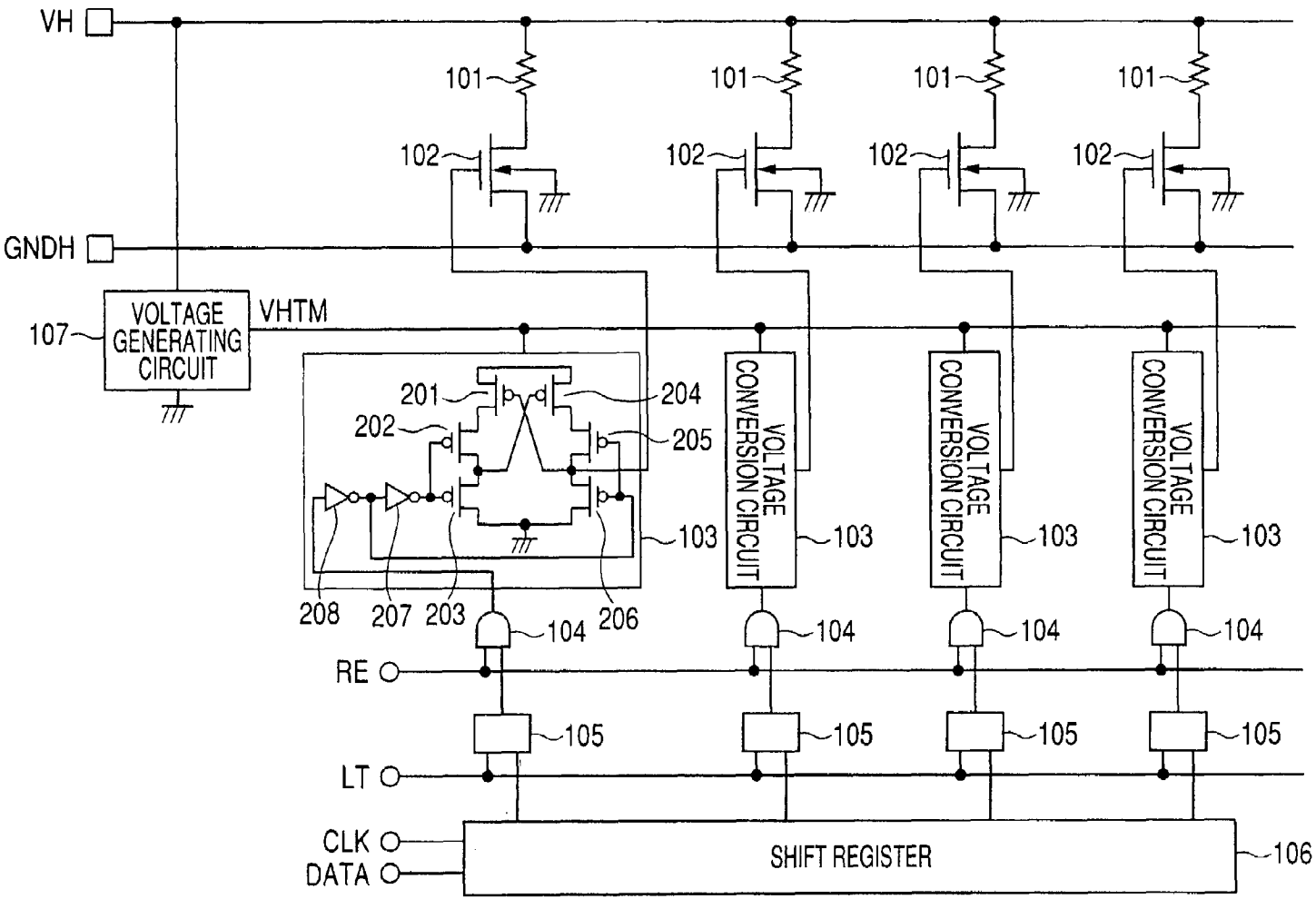
FIG. 13 is a diagram showing a circuit construction of a recording head mounted on a recording apparatus of a conventional ink jet system.
Figure 14:
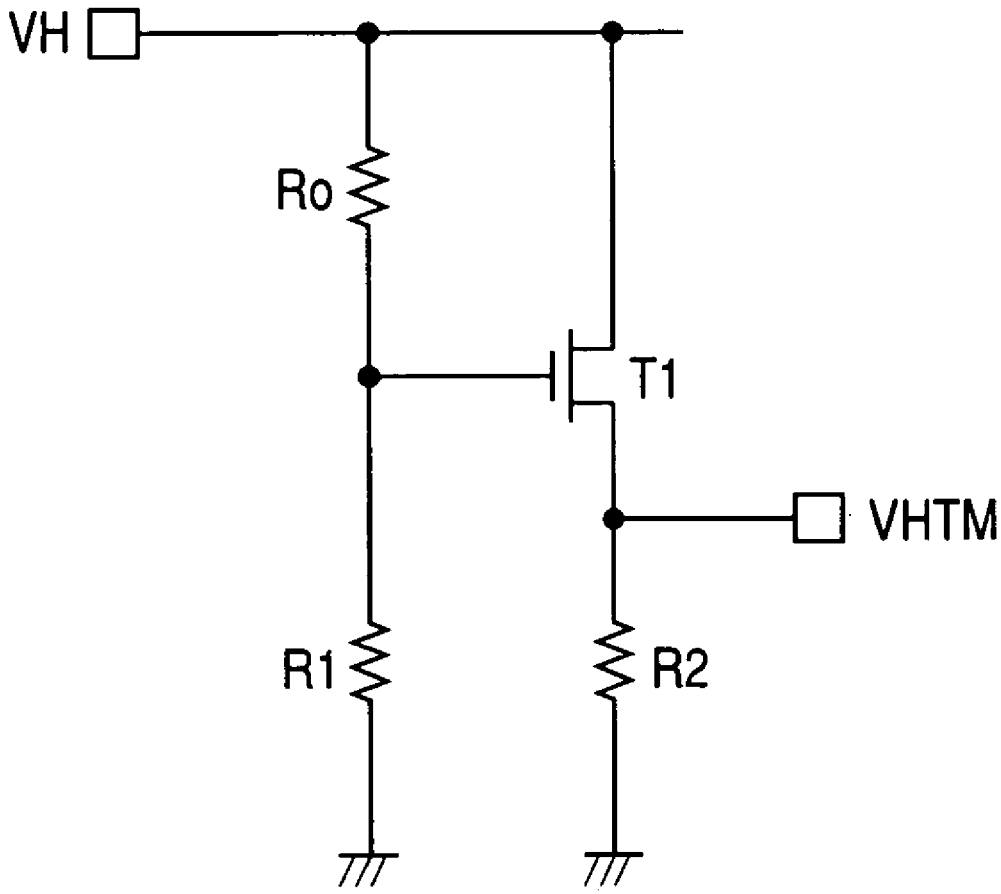
FIG. 14 is a diagram showing a circuit construction of a voltage generating circuit shown in FIG. 13.
Figure 15:
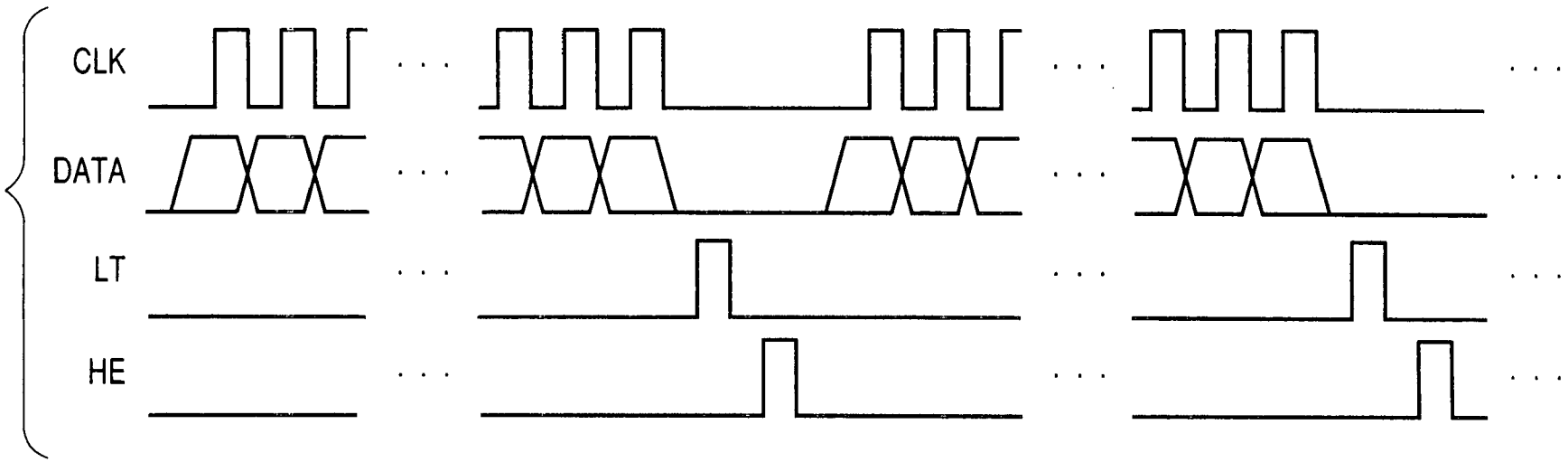
FIG. 15 is a timing chart for various signals for driving a drive circuit of the recording head shown in FIG. 13.

In the voltage generating circuit in the embodiment, one terminal of the resistor R1 as a first resistance element constructing the first current-voltage conversion circuit is connected to the gate of the nMOS transistor T1 as a first transistor and the other terminal of the resistor R1 is connected to the GND potential. The source of the transistor T1 is connected to one terminal of the resistor R2 and the other terminal of the resistor R2 is connected to the GND potential. The source of the transistor T1 becomes the output terminal of the voltage generating circuit. As an internal power line constructing the recording head, the voltage generating circuit supplies the power source VHTM to the voltage conversion circuit as shown in FIG. 13. Further, it supplies the voltage for the control signal to control the power transistor 102 (refer to FIG. 13). The drain of the transistor T1 is connected to the power line VH as a first power source.

A drain of a pMOS transistor T2 as a second transistor constructing a voltage control current source is connected to the connecting point of the resistor R1 and the gate of the transistor T1. The current supplied through the transistor T2 is supplied to the resistor R1, thereby generating the voltage V1 which is applied to the gate of the transistor T1.

A source of the pMOS transistor T2 and a source of a pMOS transistor T3 as a third transistor constructing a second current-voltage conversion circuit are connected to the power line VH as a first power source. A gate of the transistor T2 is connected to a gate of the transistor T3 and a drain of the transistor T3. That is, the transistors T2 and T3 construct a current mirror circuit.

The drain and gate of the transistor T3 are connected to a drain of an nMOS transistor T4 as a fourth transistor. A source of the transistor T4 is connected to one terminal of a third resistor R3 and connected to a negative input terminal of a differential amplifier AMP1. An output terminal of the differential amplifier AMP1 is connected to a gate of the transistor T4. The other terminal of the resistor R3 is connected to the GND potential. The differential amplifier AMP1 is constructed between a power line VDD of the logic unit and the GND potential.

One terminal of a fourth resistor R4 is connected to the power line VDD and the other terminal is connected to an anode of a diode D1. A cathode of the diode D1 is connected to the GND potential.

The resistor R4 and the diode D1 are serially connected as mentioned above. Assuming that a voltage generated at a connecting point of the resistor R4 and the diode D1 is equal to V2, the voltage V2 is inputted to a positive (+) input terminal of the differential amplifier AMP1 as a second reference voltage.

In the above construction, a voltage which is inputted to the gates of the pMOS transistors T2 and T3 is correlated to an output current from a third voltage-current conversion circuit (the nMOS transistor T4 and the resistor R3) for generating a current on the basis of the second reference voltage V2.

The resistor R4 and the diode D1 for generating the second reference voltage V2 will now be described. First, the reason why the reference voltage V2 is generated from the power line VDD which is used in the logic unit is that the voltage of the logic unit is hardly changed during the development of the recording head unlike a high voltage power line VH to which the heater has been connected. This is also because there is such an advantage that even if the power voltage fluctuates due to current consumption in the logic unit, a forward-directional voltage Vf which is generated when the current is supplied to the diode is insensitive (is hardly changed) to the current change. Since the diode has negative temperature characteristics, if a resistor having the negative temperature characteristics is connected (in other words, if the resistor R4 as a second resistance element has the negative temperature characteristics), the reference voltage which is stable even for the temperature can be provided.

The operation of the voltage generating circuit according to the embodiment will now be simply described.

The differential amplifier AMP1 controls a gate potential of the transistor T4 so that the second reference voltage V2 and a source potential V3 of the transistor T4 are equal. Thus, a current is generated by a potential difference generated across the resistor R4 and the current is supplied to the resistor R1 through the current mirror structure constructed by the transistors T2 and T3. Therefore, the gate voltage V1 (first reference voltage as a control voltage) of the transistor T1 is determined and a power voltage (V1−Vgs) is supplied to the voltage conversion circuit constructing the recording head. Vgs denotes a voltage between the gate and the source of the transistor T1. The voltage (V1−Vgs) is equal to the voltage VHTM.

As will be understood from the above description, if the voltage generating circuit having the construction of the embodiment is used for the recording head, the voltage V1 (first reference voltage) inputted to the gate of the transistor T1 becomes a voltage which does not depend on the fluctuation in the power line VH. The transistor T1 can generate the stable voltage. Since the voltage V1 inputted to the gate of the transistor T1 does not depend on the fluctuation in the power line VH, even if the power voltage of the power line VH supplied to the heater is changed, the output voltage VHTM of the voltage generating circuit does not change. Therefore, even after the recording head is formed, the heat energy generated by the heater can be adjusted. Consequently, since there is no need to newly manufacture the recording head (particularly, the voltage generating circuit) by re-designing it in order to adjust the discharging energy, the developing time of the recording head can be shortened and the developing costs can be reduced. Further, since the reference current source is constructed by the same low voltage as the logic power voltage, from a viewpoint of the electric power consumption, the above construction is more advantageous than that in which the reference current source is constructed by the high voltage power source VH. There is also such an advantage that the number of power sources which are needed by the recording head and supplied from the outside can be decreased.

Also in the embodiment, an example in which the nMOS transistor as a field effect transistor is used as a transistor connected to the output terminal has been described. However, the transistor connected to the output terminal is not always limited to it but an npn transistor can be also used.

Third Embodiment

Figure 3:
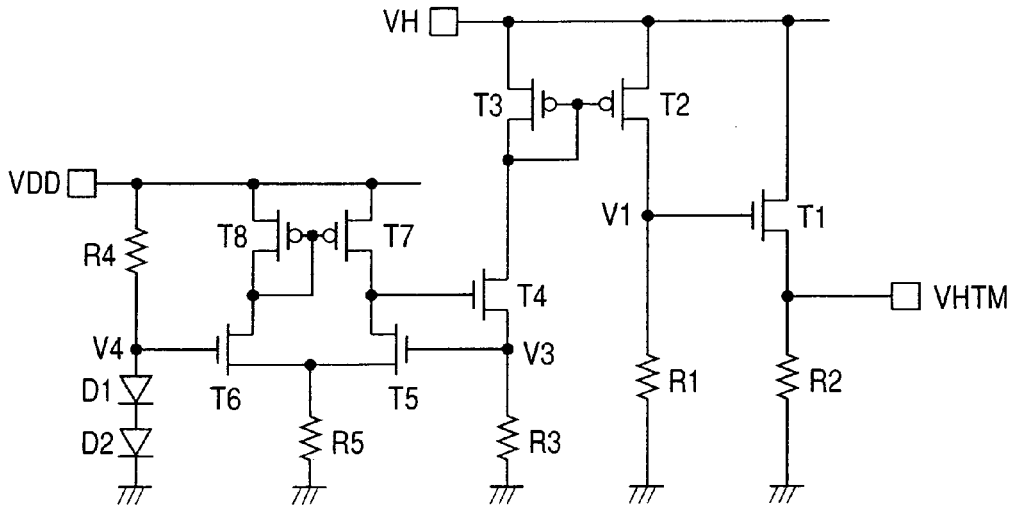
FIG. 3 is a circuit diagram showing a construction of a voltage generating circuit in a drive circuit for driving a recording head according to the third embodiment of the invention.

FIG. 3 is a circuit diagram showing a construction of a voltage generating circuit in a drive circuit for driving a recording head according to the third embodiment of the invention. Since portions other than the voltage generating circuit of the drive circuit in the recording head of the embodiment are similar to those in the prior art shown in FIG. 13 in a manner similar to the foregoing embodiments, explanation of the other portions of the drive circuit is omitted.

In the voltage generating circuit in the embodiment, one terminal of the resistor R1 as a first resistance element constructing the first current-voltage conversion circuit is connected to the gate of the nMOS transistor T1 as a first transistor and the other terminal of the resistor R1 is connected to the GND potential. The source of the transistor T1 is connected to one terminal of the second resistor R2 and the other terminal of the resistor R2 is connected to the GND potential. The source of the transistor T1 becomes the output terminal of the voltage generating circuit. As an internal power line constructing the recording head, the voltage generating circuit supplies the power source VHTM to the voltage conversion circuit as shown in FIG. 13. Further, it supplies the voltage for the control signal to control the power transistor 102 (refer to FIG. 13). The drain of the transistor T1 is connected to the power line VH as a first power source.

The drain of a pMOS transistor T2 as a second transistor constructing the voltage control current source is connected to the connecting point of the resistor R1 and the gate of the transistor T1. The current supplied through the transistor T2 is supplied to the resistor R1, thereby generating the first reference voltage V1 as a control voltage which is applied to the gate of the transistor T1.

The source of the pMOS transistor T2 and the source of the pMOS transistor T3 as a third transistor constructing the second current-voltage conversion circuit are connected to the power line VH. The gate of the transistor T2 is connected to the gate of the transistor T3 and the drain of the transistor T3. In other words, the transistors T2 and T3 construct the current mirror circuit.

The drain and gate of the transistor T3 are connected to the drain of the nMOS transistor T4 as a fourth transistor. The source of the transistor T4 is connected to one terminal of the third resistor R3 and connected to a gate of an nMOS transistor T5.

The other terminal of the resistor R3 is connected to the GND potential. A drain of the transistor T5 is connected to the gate of the transistor T4 and a drain of a pMOS transistor T7. A gate of the transistor T7 is connected to a gate and a drain of a pMOS transistor T8. The transistors T7 and T8 also have the current mirror structure.

Sources of the transistors T7 and T8 are connected to the power line VDD. The power line VDD is a power source supplied to the logic unit constructing the recording head. The drain and gate of the transistor T8 are connected to an nMOS transistor T6. Sources of the transistors T5 and T6 are mutually connected and are connected to the GND potential through a fifth resistor R5.

One terminal of the resistor R4 is connected to the power line VDD as a second power source and the other terminal is connected to the anode of the first diode D1. The cathode of the diode D1 is connected to an anode of a second diode D2 and a cathode of the diode D2 is connected to the GND potential.

A voltage V4 generated at a connecting point of the resistor R4 and the diode D1 is inputted as a second reference voltage to a gate of the transistor T6.

The reason why the second reference voltage V4 in the embodiment is generated from the resistor R4 and the diodes D1 and D2 is to stably supply a current to the resistor R5 as a current source of a differential amplifier constructed by the transistors T5, T6, T7, and T8 and the resistor R5. If the current can be stably supplied to the resistor R5 by using the second reference voltage V2 (refer to FIG. 2) generated in the circuit construction described in the second embodiment, such a second reference voltage V2 can be also inputted to the gate of the transistor T6.

In the above construction, the voltage which is inputted to the gates of the pMOS transistors T2 and T3 is correlated to the output current from the third voltage-current conversion circuit (the nMOS transistor T4 and the resistor R3) for generating the current on the basis of the second reference voltage V4.

The operation of the voltage generating circuit according to the embodiment will now be simply described.

Also in the embodiment, the differential amplifier constructed by the transistors T5, T6, T7, and T8 controls the gate potential of the transistor T4 so that the second reference voltage V4 and the source potential V3 of the transistor T4 are equal. Thus, a current is generated by a potential difference occurring across the resistor R3. The current is supplied to the resistor R1 through the current mirror structure constructed by the transistors T2 and T3. Therefore, the gate voltage V1 (first reference voltage as a control voltage) of the transistor T1 is determined and the power voltage (V1−Vgs) is supplied to the voltage conversion circuit constructing the recording head. Vgs denotes the voltage between the gate and the source of the transistor T1. The voltage (V1−Vgs) is equal to the voltage VHTM.

As will be understood from the above description, also in the embodiment, the voltage V1 (first reference voltage) inputted to the gate of the transistor T1 becomes the voltage which does not depend on the fluctuation in the power line VH. The transistor T1 can generate the stable voltage. Even if the power voltage of the power line VH supplied to the heater is changed, the output voltage VHTM of the voltage generating circuit does not change even after the recording head is formed, so that the heat energy generated by the heater can be adjusted. Consequently, since there is no need to newly manufacture the recording head (particularly, the voltage generating circuit) by re-designing it in order to adjust the discharging energy, the developing time of the recording head can be shortened and the developing costs can be reduced. Further, since the reference current source is constructed by the same low voltage as the logic power voltage, from a viewpoint of the electric power consumption, the above construction is more advantageous than that in which the reference current source is constructed by the high voltage power source VH. There is also such an advantage that the number of power sources which are needed by the recording head and supplied from the outside can be decreased.

Also in the embodiment, the nMOS transistor as a field effect transistor is used as a transistor connected to the output terminal. However, the transistor connected to the output terminal is not always limited to it but an npn transistor can be also used.

Fourth Embodiment

In the voltage generating circuit in the third embodiment described with reference to FIG. 3, the voltage V1 (first reference voltage) inputted to the gate of the nMOS transistor T1 is determined only by the resistor R1. In a construction of the fourth embodiment, however, a fluctuation component or the like of the voltage Vgs between the gate and the source of the transistor T1 is included in the output voltage VHTM of the voltage generating circuit.

Figure 4:
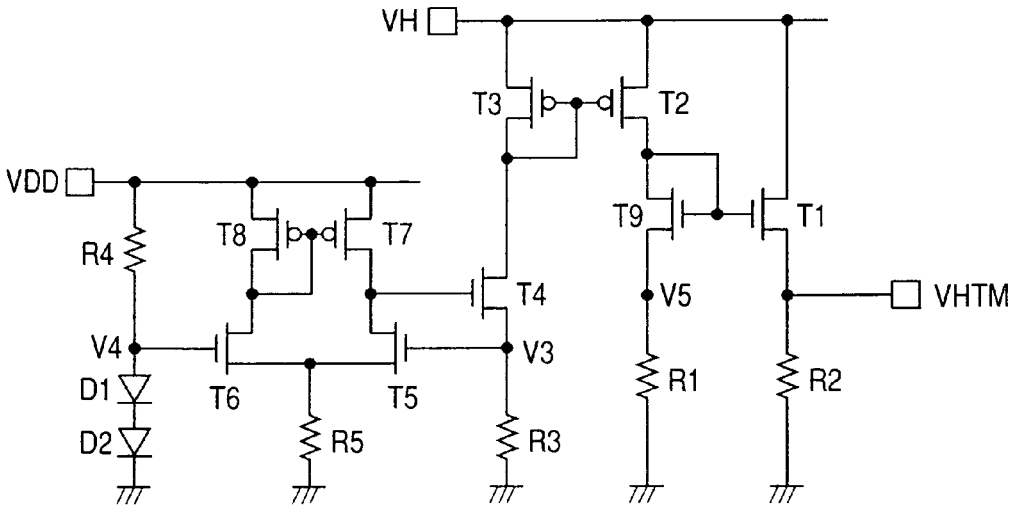
FIG. 4 is a circuit diagram showing a construction of a voltage generating circuit in a drive circuit for driving a recording head according to the fourth embodiment of the invention.

In the embodiment, therefore, to stabilize the output voltage VHTM of the voltage generating circuit irrespective of the voltage Vgs of the transistor T1, as shown in FIG. 4, an nMOS transistor T9 is provided between the drain of the transistor T2 and the resistor R1. Since the voltage generating circuit of FIG. 4 according to the fourth embodiment is substantially the same as that of the third embodiment shown in FIG. 3 except for a point that the transistor T9 is provided, only different points will be described hereinbelow.

As shown in FIG. 4, the voltage generating circuit of the fourth embodiment is constructed in such a manner that the current supplied through the transistor T2 as described in the foregoing embodiment is supplied to the resistor R1 through the nMOS transistor T9. Specifically speaking, a gate and a drain of the transistor T9 are connected to the drain of the transistor T2 and the gate of the transistor T1 and a source of the transistor T9 is connected to the resistor R1. A voltage correlated to a voltage V5 as a first reference voltage serving as a control voltage generated by supplying the constant current to the resistor R1 is inputted to the gate of the transistor T1. Density of the current flowing in the transistor T1 in the stationary state and that in the transistor T9 are equalized.

By using the construction of the embodiment, the output voltage VHTM of the voltage generating circuit can be stabilized irrespective of the voltage Vgs between the gate and the source of the transistor T1. The output voltage VHTM is a voltage that is equal to the voltage V5 as a first reference voltage. Therefore, the output voltage VHTM becomes the voltage correlated to the power voltage VDD and the design and management of the output voltage can be easily performed.

Effects similar to those in the foregoing embodiments can be also obtained in the case where the voltage generating circuit according to the embodiment is used for the recording head.

Also in the embodiment, the nMOS transistor as a field effect transistor is used as a transistor connected to the output terminal. However, the transistor connected to the output terminal is not always limited to it but an npn transistor can be also used.

Fifth Embodiment

Figure 5:
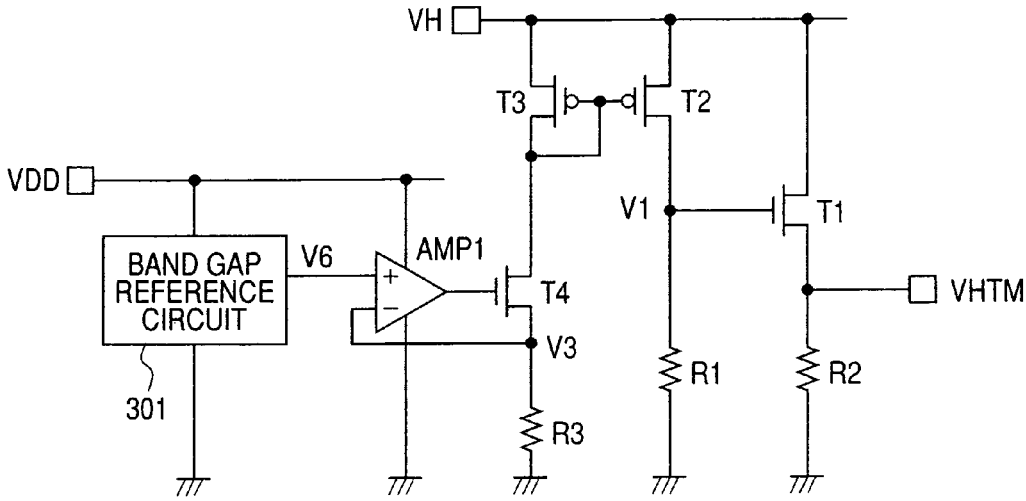
FIG. 5 is a circuit diagram showing a construction of a voltage generating circuit in a drive circuit for driving a recording head according to the fifth embodiment of the invention.

FIG. 5 is a circuit diagram showing a construction of a voltage generating circuit in a drive circuit for driving a recording head according to the fifth embodiment of the invention. Since portions other than the voltage generating circuit of the drive circuit in the recording head of the embodiment are similar to those in the prior art shown in FIG. 13 in a manner similar to the foregoing embodiments, explanation of the other portions of the drive circuit is omitted.

The voltage generating circuit in the embodiment is constructed in such a manner that in place of the resistor R5 and the diode D1 in the voltage generating circuit with the construction shown in FIG. 2, a band gap reference circuit 301 is used to thereby generate a voltage V6 as a second reference voltage. Since other constructions in the voltage generating circuit of the embodiment are simlilar to those of the voltage generating circuit shown in FIG. 2, their detailed explanation is omitted here.

As shown in FIG. 5, the band gap reference circuit 301 is provided between the power line VDD of the logic unit and the GND potential and its output voltage V6 is inputted to the positive (+) input terminal of the differential amplifier AMP1. The reason why the second reference voltage V6 is generated from the power line VDD which is used in the logic unit is that the voltage of the logic unit is hardly changed during the development of the recording head unlike a high voltage power line VH to which the heater has been connected.

As mentioned above, by using the band gap reference circuit 301 for the generation of the second reference voltage V6, the second reference voltage V6 in which a fluctuation against the temperature is small and which hardly depends on the fluctuation in the power voltage VDD can be obtained.

In the voltage generating circuit with the construction shown in FIG. 5, the voltage V1 (first reference voltage as a control voltage) inputted to the gate of the transistor T1 as a first transistor is determined only by the resistor R1. In this construction, there is a case where a fluctuation component or the like of the voltage Vgs between the gate and the source of the transistor T1 is included in the output voltage VHTM of the voltage generating circuit. Therefore, the construction of FIG. 4 can be applied in order to stabilize the output voltage VHTM of the voltage generating circuit irrespective of the voltage Vgs of the transistor T1. As described in FIG. 4, by connecting the gate and drain of the transistor T9 to the drain of the transistor T2 and the gate of the transistor T1 and connecting the source of the transistor T9 to the resistor R1, correction for the fluctuation component or the like of the voltage Vgs between the gate and the source of the transistor T1 can be also made.

Sixth Embodiment

Figure 6:
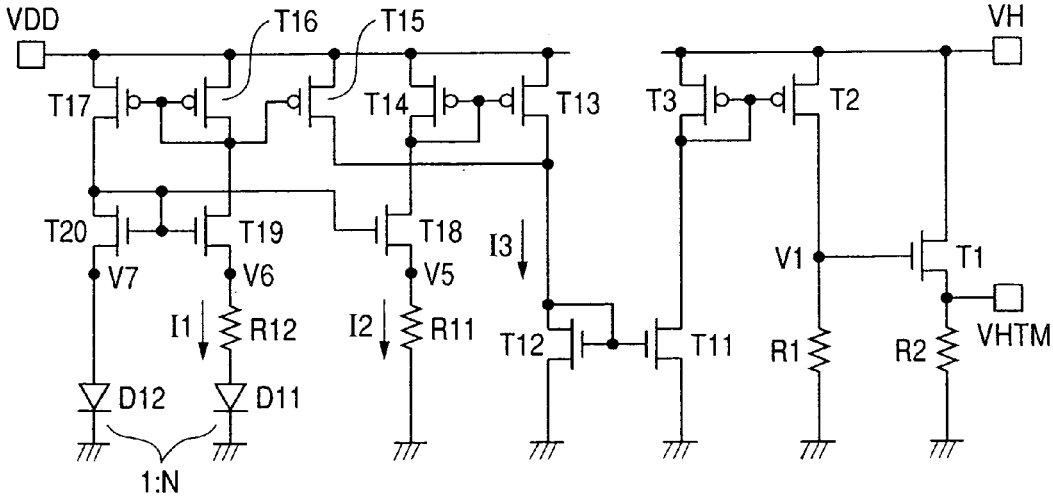
FIG. 6 is a circuit diagram showing a construction of a voltage generating circuit in a drive circuit for driving a recording head according to the sixth embodiment of the invention.

FIG. 6 is a circuit diagram showing a construction of a voltage generating circuit in a drive circuit for driving a recording head according to the sixth embodiment of the invention. Since portions other than the voltage generating circuit of the drive circuit in the recording head of the embodiment are similar to those in the prior art shown in FIG. 13 in a manner similar to the foregoing embodiments, explanation of the other portions of the drive circuit is omitted.

The sixth embodiment is similar to the fifth embodiment with respect to a point that a band gap reference circuit is used. However, in the voltage generating circuit in the fifth embodiment shown in FIG. 5, the second reference voltage V6 which does not depend on the temperature is generated and converted into the constant current, and the first reference voltage V1 is generated on the basis of the constant current. On the other hand, the voltage generating circuit in the embodiment shown in FIG. 6 differs from that in the fifth embodiment with respect to a point that a reference current I3 which does not depend on the temperature is generated and the first reference voltage V1 is generated on the basis of the reference current 13.

In the voltage generating circuit in the embodiment, one end of the resistor R1 as a first resistance element constructing the first current-voltage conversion circuit is connected to the gate of the nMOS transistor T1 as a first transistor. The other terminal of the resistor R1 is connected to the GND potential. The source of the transistor T1 is connected to one terminal of the resistor R2. The other terminal of the resistor R2 is connected to the GND potential. The source of the transistor T1 becomes the output terminal of the voltage generating circuit. As an internal power line constructing the recording head, the voltage generating circuit supplies the power source VHTM to the voltage conversion circuit as shown in FIG. 13. Further, it supplies the voltage for the control signal to control the power transistor 102 (refer to FIG. 13). The drain of the transistor T1 is connected to the power line VH as a first power source.

The drain of the pMOS transistor T2 as a second transistor constructing the voltage control current source is connected to the connecting point of the resistor R1 and the gate of the transistor T1. The current supplied through the transistor T2 is supplied to the resistor R1, thereby generating the voltage which is applied to the gate of the transistor T1. The source of the pMOS transistor T2 and the source of the pMOS transistor T3 as a third transistor constructing the second current-voltage conversion circuit are connected to the power line VH. The gate of the transistor T2 is connected to the gate and drain of the transistor T3. That is, the transistors T2 and T3 construct a current mirror structure.

The drain and gate of the transistor T3 are connected to a drain of an nMOS transistor T11 as a transistor constructing a voltage control current source. A source of the transistor T11 is connected to the GND potential. A gate of the transistor T11 is connected to a gate and a drain of an nMOS transistor T12, a drain of a pMOS transistor T13, and a drain of a pMOS transistor T15, respectively. A source of the transistor T12 is connected to the GND potential. As mentioned above, the transistors T11 and T12 construct a current mirror structure.

A source of the transistor T13 and a source of a pMOS transistor T14 are connected to the power line VDD. A gate of the transistor T13 is connected to a gate and a drain of the transistor T14. The transistors T13 and T14 construct a current mirror structure. The gates of the transistors T13 and T14 and the drain of the transistor T14 are connected to a drain of an nMOS transistor T18.

A source of the transistor T15, a source of a pMOS transistor T16, and a source of a pMOS transistor T17 are connected to the power line VDD. A gate of the transistor T15 is connected to a gate and a drain of the transistor T16, a gate of the transistor T17, and a drain of an nMOS transistor T19, respectively. The transistors T15, T16, and T17 construct a current mirror structure as mentioned above.

A source of the transistor T18 is connected to one terminal of a resistor R11. The other terminal of the resistor R11 is connected to the GND potential. A gate of the transistor T18 is connected to a gate of the transistor T19, a gate and a drain of an nMOS transistor T20, and a drain of the transistor T17. A source of the transistor T19 is connected to one terminal of a resistor R12. The other terminal of the resistor R12 is connected to an anode of a first diode D11. A cathode of the first diode D11 is connected to the GND potential. A source of the transistor T20 is connected to an anode of a second diode D12. A cathode of the second diode D12 is connected to the GND potential.

The operation of the voltage generating circuit according to the embodiment will now be described.

Assuming that the voltage Vgs between the gate and the source of each of the transistors T20, T19, and T18 is the same, voltages V6, V7, and V8 shown in FIG. 6 are set as a same electric potential $V_{BE12}$ (forward-directional voltage of the second diode D12). Therefore, a current I1 flowing in the resistor R12 is obtained by the following equation (1).

$$I_1 = \frac{(V_{BE12} - V_{BE11})}{R12} \tag{1}$$

where, $V_{BE11}$: forward-directional voltage of the first diode D11

Now, assuming that currents flowing in the diodes D11 and D12 are the same and their area ratio is set as (1:N), the following equation (2) is obtained.

$$\frac{\exp\left(\frac{qV_{BE11}}{kT}\right)}{N} = \exp\left(\frac{qV_{BE12}}{kT}\right) \tag{2}$$

From the equation (2), the following equation (3) is obtained.

$$V_{BE12} - V_{BE11} = \frac{kT}{q}\ln(N) \tag{3}$$

By substituting the equation (3) into the equation (1), the following equation (4) is obtained.

$$I_1 = \frac{1}{R12} \times \frac{kT}{q}\ln(N) \tag{4}$$

A change in current due to the temperature change is expressed by the following equation $$\Delta I_1 = \frac{1}{R12} \times \frac{k}{q} \ln(N) \times \Delta T \quad (5)$$

and has the positive temperature characteristics. A current I2 flowing in the resistor R11 is expressed by following equation (6).

$$I_2 = \frac{1}{R11} \times V_{BE12} \quad (6)$$

Since $V_{BE12}$ is almost proportional to −2 mV/° C. ($V_{BE12} \propto -2$ mV/° C.) here, the change in current due to the temperature change of the current I2 is expressed by the following equation $$\Delta I_2 = \frac{1}{R11} \times (-0.002) \Delta T \quad (7)$$

it has the negative temperature characteristics. A current I3 flowing in the transistor T12 is a current obtained by mixing the currents I1 and I2 at a proper ratio (1:M). From the equations (5) and (6), a change in current I3 due to the temperature change is expressed by the following equation $$\Delta I_3 = \Delta I1 + M \times \Delta I2 = \frac{1}{R12} \times \frac{k}{q} \ln(N) \times \Delta T + M \times \frac{1}{R11} \times (-0.002) \Delta T \quad (8)$$

By setting the mixture ratio M so that I3=0 is obtained, the reference current I3 which does not depend on the temperature can be generated.

The voltage generating circuit of the embodiment generates the reference current I3 which does not depend on the temperature as mentioned above. By supplying the current to the resistor R1 on the basis of it, the first reference voltage V1 in which the fluctuation against the temperature is small and which hardly depends on the fluctuation in the power line VH and the power voltage VDD can be generated. The reason why the reference current I3 is generated from the power line VDD which is used in the logic unit is that the voltage of the logic unit is hardly changed during the development of the recording head unlike a high voltage power line VH to which the heater has been connected.

In the voltage generating circuit having the construction shown in FIG. 6, the voltage V1 (first reference voltage) inputted to the gate of the nMOS transistor T1 as a first transistor is determined only by the resistor R1. In this construction, however, there is a case where the fluctuation component or the like of the voltage Vgs between the gate and the source of the transistor T1 is included in the output voltage VHTM of the voltage generating circuit. Therefore, to stabilize the output voltage VHTM of the voltage generating circuit irrespective of the voltage Vgs of the transistor T1, the construction of FIG. 4 can be applied. As described in conjunction with FIG. 4, by connecting the gate and drain of the transistor T9 to the drain of the transistor T2 and the gate of the transistor T1 and by connecting the source of the transistor T9 to the resistor R1, the fluctuation component or the like of the voltage Vgs between the gate and the source of the transistor T1 can be also corrected.

Seventh Embodiment

Figure 7:
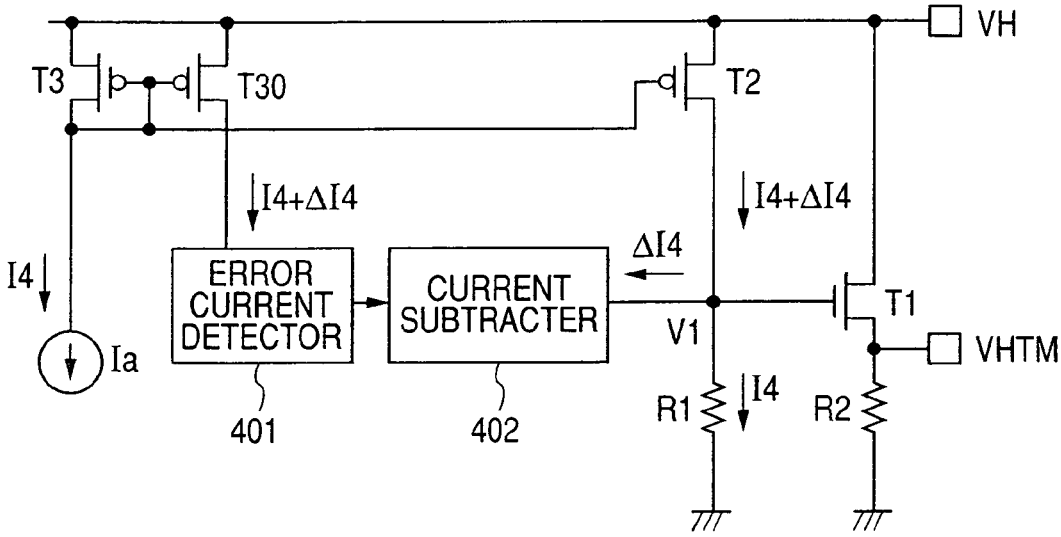
FIG. 7 is a circuit diagram showing a construction of a voltage generating circuit in a drive circuit for driving a recording head according to the seventh embodiment of the invention.
Figure 8:
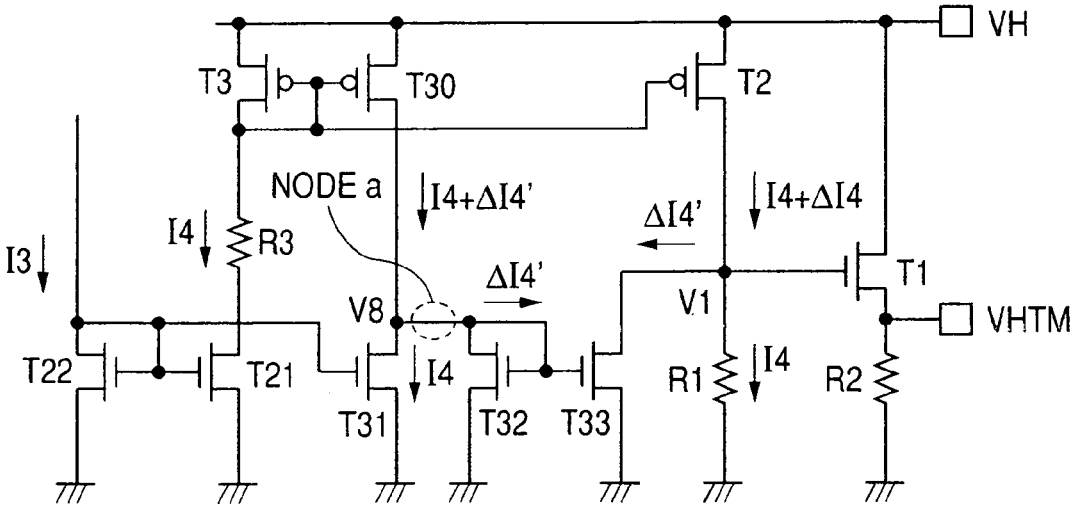
FIG. 8 is a circuit diagram showing an example of the voltage generating circuit with the construction shown in FIG. 7.

FIG. 7 is a circuit diagram showing a construction of a voltage generating circuit in a drive circuit for driving a recording head according to the seventh embodiment of the invention. FIG. 8 is a circuit diagram showing an example of the voltage generating circuit with the construction shown in FIG. 7. Since portions other than the voltage generating circuit of the drive circuit in the recording head of the embodiment are similar to those in the prior art shown in FIG. 13 in a manner similar to the foregoing embodiments, explanation of the other portions of the drive circuit is omitted.

The voltage generating circuit in the embodiment has an error current detector 401 for detecting a current error due to Early effect of the pMOS transistor T2 as a second transistor constructing the voltage control current source. The voltage generating circuit further has error current eliminating means including a current subtractor 402 for subtracting the error current from the output current and allows the first reference voltage V1 which does not depend on the voltage fluctuation of the power line VH to be generated.

In the voltage generating circuit in the embodiment, one end of the resistor R1 as a first resistance element constructing the first current-voltage conversion circuit is connected to the gate of the nMOS transistor T1 as a first transistor. The other terminal of the resistor R1 is connected to the GND potential. The source of the transistor T1 is connected to one terminal of the resistor R2. The other terminal of the resistor R2 is connected to the GND potential. The source of the transistor T1 becomes the output terminal of the voltage generating circuit. As an internal power line constructing the recording head, the voltage generating circuit supplies the power source VHTM to the voltage conversion circuit as shown in FIG. 13. Further, it supplies the voltage for the control signal to control the power transistor 102 (refer to FIG. 13). The drain of the transistor T1 is connected to the power line VH as a first power source.

The drain of the pMOS transistor T2 as a second transistor constructing the voltage control current source is connected to the connecting point of the resistor R1 and the gate of the transistor T1. Thus, the current supplied through the transistor T2 is supplied to the resistor R1, thereby generating the voltage which is applied to the gate of the transistor T1. The source of the transistor T2, the source of the pMOS transistor T3, and a source of a pMOS transistor T30 are connected to the power line VH. The gate of the transistor T2 is connected to a gate of the transistor T30, the gate and drain of the transistor T3, and a constant current source Ia. As mentioned above, the transistors T2, T3, and T30 construct a current mirror structure.

A drain of the transistor T30 is connected to the error current detector 401. The error current detected by the error current detector 401 is subtracted from the output current of the transistor T2 by the current subtractor 402 connected to the drain of the transistor T2.

An example of the voltage generating circuit having the construction shown in FIG. 7 will be specifically explained with reference to FIG. 8. The error current detector 401 and the current subtractor 402 shown in FIG. 7 are mainly constructed by transistors T31, T32, and T33 shown in FIG. 8.

The drain of the transistor T30 is connected to a drain of the nMOS transistor T31, a drain and a gate of the nMOS transistor T32, and a gate of the nMOS transistor T33. A source of the transistor T31 is connected to the GND potential. A gate of the transistor T31 is connected to a gate of an nMOS transistor T21 and a gate and a drain of an nMOS transistor T22. The gates of the transistors T21 and T22 are mutually connected and construct a current mirror structure.

A source of the transistor T32 and a source of the transistor T33 are connected to the GND potential. The gates of the transistors T32 and T33 are mutually connected and construct a current mirror structure. A drain of the transistor T33 is connected to a connecting point of the drain of the transistor T2, the gate of the transistor T1, and the resistor R1.

The operation of the voltage generating circuit according to the embodiment will now be described with reference to FIG. 8.

A constant current 14 flowing in the drain side of the transistor T3 is returned by each of the transistors T2 and T30 constructing the current mirror structure. The current which was returned by the transistor T2 and flows in the drain side includes the error current due to the Early effect of the transistor T2 and becomes (I4+ΔI4). The current which was returned by the transistor T30 and flows in the drain side also includes the error current due to the Early effect of the transistor T30 and becomes (I4+ΔI4').

Since the transistor T31 is a current source for supplying the current 14, the current of I4+ΔI4'−I4=ΔI4' is supplied to the drain of the transistor T32. The current ΔI4' is returned by the current mirror structure constructed by the transistors T32 and T33 and flows to the drain side of the transistor T33. The current ΔI4' is subtracted from the current I4+ΔI4 flowing from the drain of the transistor T2. Thus, the current flowing in the resistor R1 becomes (I4+ΔI4−IΔ4'). Therefore, if the circuit is designed so that ΔI4=ΔI4' is obtained, only the current I4 from the current source flows to the resistor R1, the error current due to the Early effect of the transistor T2 can be eliminated.

To design the circuit so as to obtain ΔI4=ΔI4', it is necessary to set the voltage V8 and the voltage V1 in FIG. 8 to the same electric potential. As a method of realizing such a construction, there is a method whereby a resistor or a diode is inserted to a node (a) (between the drain of the transistor T31 and the drain of the transistor T32) shown in FIG. 8.

Although the embodiment has been described above on the assumption that the influence of the Early effect of the current mirror structure constructed by the nMOS transistors is ignored, as a method of suppressing the Early effect of the current mirror structure constructed by the nMOS transistors, a method of cascade-connecting the current mirror structures or the like can be used.

As described above, according to the construction of the embodiment, the early effect of the transistor T2 can be suppressed and the fluctuation of the output voltage (VHTM) due to the voltage fluctuation of the power line VH can be suppressed.

Other Embodiments

Figure 9:
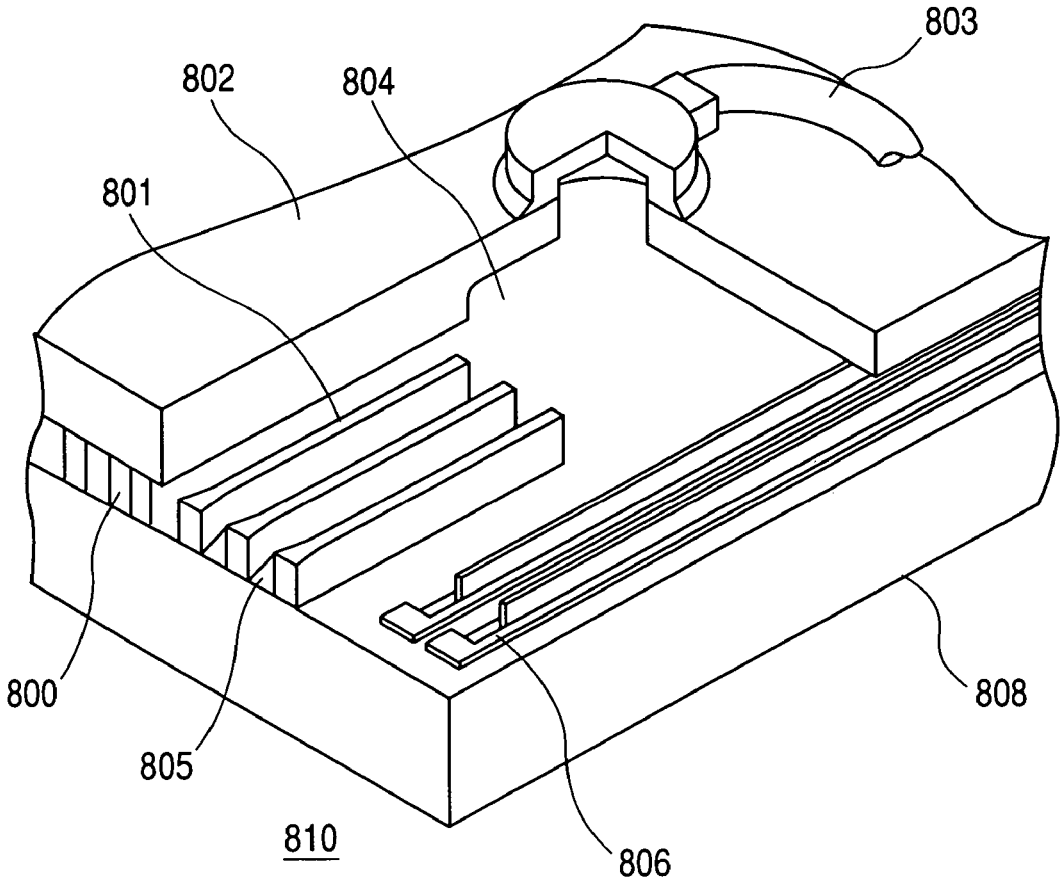
FIG. 9 is a perspective view showing a detailed construction of a base substance for an ink jet recording head.

A base substance for the ink jet recording head having the circuit structure of one of the first to seventh embodiments will now be described. FIG. 9 is a perspective view showing a detailed construction of the base substance for the ink jet recording head.

As shown in FIG. 9, a base substance 808 for the ink jet recording head can construct a recording head 810 of the ink jet recording system by assembling: flow path wall members 801 to form liquid paths 805 communicating with a plurality of discharge ports 800; and a top plate 802 having an ink supply port 803. In this case, ink which is injected from the ink supply port 803 is stored in an internal common liquid chamber 804 and supplied to each liquid path 805. By driving heat generating units 806 on the base substance 808 in this state, the ink is discharged from the discharge ports 800.

By attaching the recording head 810 shown in FIG. 9 to the ink jet recording apparatus main body and controlling a signal supplied from the apparatus main body to the recording head 810, the ink jet recording apparatus which can realize the recording of a high operating speed and high picture quality can be provided.

Figure 10:
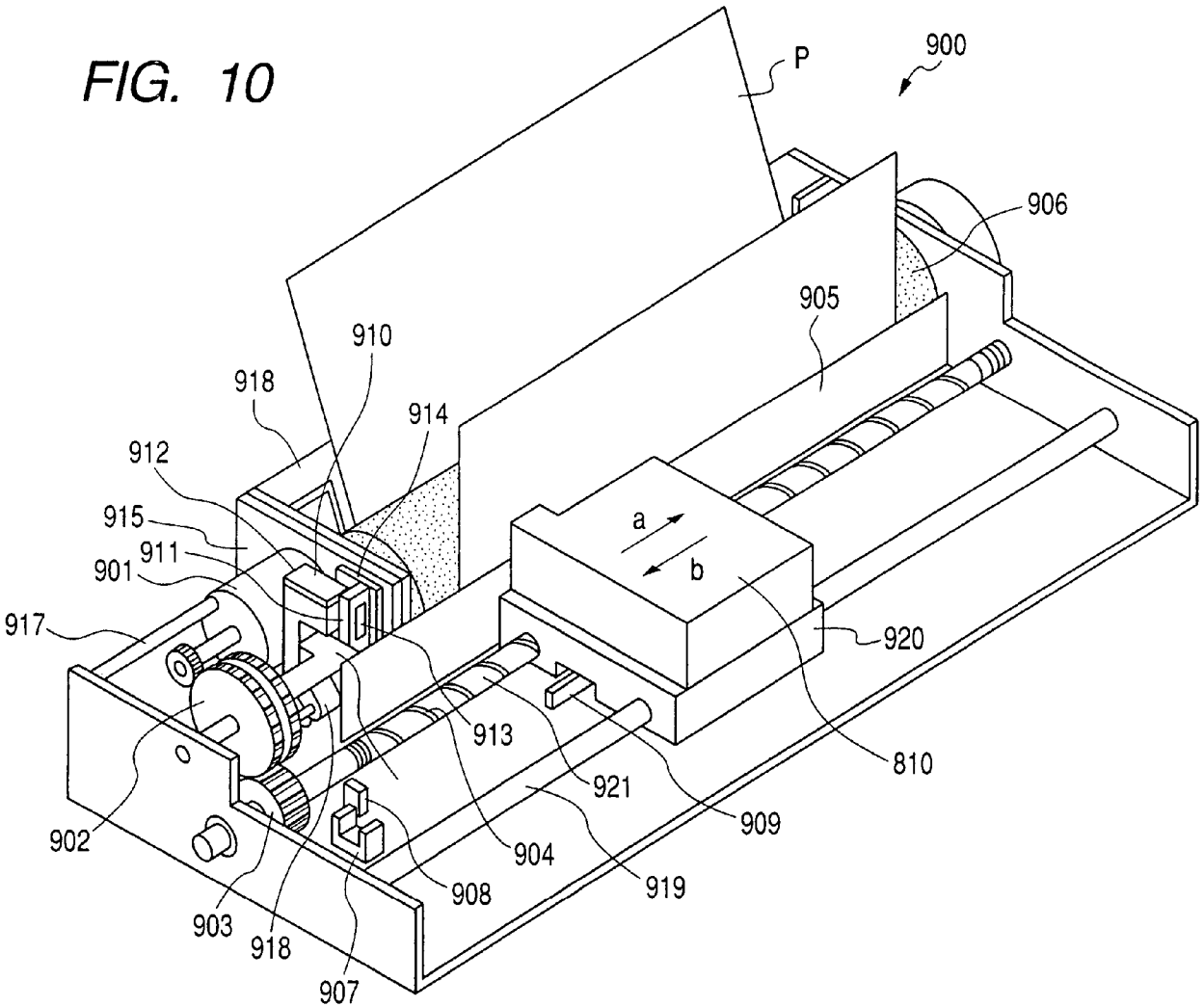
FIG. 10 is an external perspective view showing an ink jet recording apparatus according to the embodiment of the invention.

The ink jet recording apparatus using the recording head 810 shown in FIG. 9 will now be described. FIG. 10 is an external perspective view showing an ink jet recording apparatus 900 according to the embodiment of the invention.

In FIG. 10, the recording head 810 is mounted on a carriage 920 which is come into engagement with a spiral groove 921 of a lead screw 904 which is rotated through driving force transfer gears 902 and 903 in association with the forward/reverse rotation of a driving motor 901. The recording head 810 can be reciprocatively moved in the direction shown by an arrow (a) or (b) along a guide 919 together with the carriage 920 by the driving force of the driving motor 901. A paper pressing plate 905 for recording paper P which is conveyed on a platen 906 by a recording medium feeding apparatus (not shown) presses the recording paper P onto the platen 906 along the carriage moving direction.

Photocouplers 907 and 908 are home position detecting means for confirming the existence in a region of a lever 909 provided for the carriage 920 where the photocouplers 907 and 908 are provided and performing the switching or the like of the rotating direction of the driving motor 901. A supporting member 910 supports a cap member 911 to cap the whole surface of the recording head 810. Suction means 912 sucks the inside of the cap member 911 and executes a suction recovery of the recording head 810 through an opening 913 in the cap. A moving member 915 enables a cleaning blade 914 to be moved in the front/rear directions. The cleaning blade 914 and the moving member 915 are supported to a main body supporting plate 916. Naturally, the cleaning blade 914 is not limited to a structure shown in the diagram but a well-known cleaning blade can be applied to the embodiment. A lever 917 is provided to start the suction of the suction recovery and moved in association with the movement of a cam 918 which is come into engagement with the carriage 920. A driving force from the driving motor 901 is transferred by well-known propagating means such as a clutch change-over or the like. A recording control unit (not shown) for supplying signals to the heat generating units 806 provided for the recording head 810 and controlling the driving of each mechanism such as a driving motor 901 or the like is provided on the apparatus main body side.

In the ink jet recording apparatus 900 having the construction as mentioned above, while the recording head 810 is reciprocatively moved over the whole width of the recording paper P, it executes the recording onto the recording paper P conveyed on the platen 906 by the recording medium feeding apparatus. Since the recording head 810 is manufactured by using a base substance for the ink jet recording head having the circuit structure of each of the embodiments, the recording can be executed at high precision and a high speed.

Figure 11:
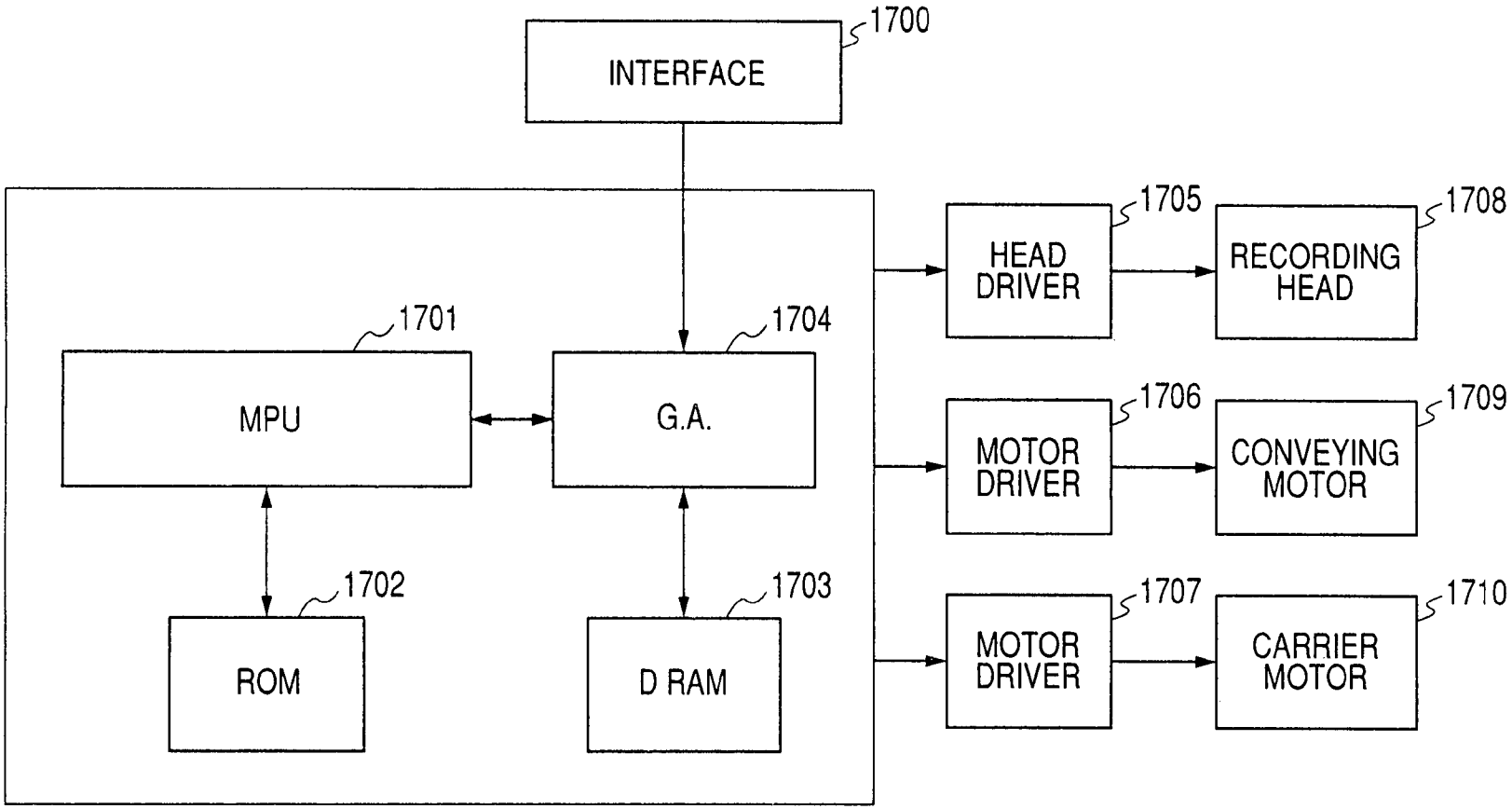
FIG. 11 is a block diagram showing a construction of a control circuit of the ink jet recording apparatus.

A construction of a control circuit for executing the recording control of the apparatus mentioned above will now be described. FIG. 11 is a block diagram showing a construction of a control circuit of the ink jet recording apparatus 900. In the diagram showing the control circuit, reference numeral 1700 denotes an interface for inputting the recording signal; 1701 an MPU; 1702 a program ROM for storing a control program which is executed by the MPU 1701; and 1703 a dynamic RAM (DRAM) for storing various data (the recording signal, the recording data which is supplied to the head, etc.).

Reference numeral 1704 denotes a gate array for controlling supply of the recording data for a recording head 1708. The gate array 1704 also controls data transfer among the interface 1700, MPU 1701, and RAM 1703. Reference numeral 1710 denotes a carrier motor for conveying the recording head 1708; 1709 a conveying motor for conveying the recording paper; 1705 a head driver for driving the head; 1706 a motor driver for driving the conveying motor 1709; and 1707 a motor driver for driving the carrier motor 1710.

The operation of the above construction will be described. When the recording signal is inputted to the interface 1700, it is converted into the printing recording data by the gate array 1704 and the MPU 1701. The motor drivers 1706 and 1707 are driven, the recording head is driven in accordance with the recording data sent to the head driver 1705, and the recording operation is executed.

Although the example in which the base substance for the ink jet recording head is used for the recording head of the ink jet system has been described above, the base substance structure based on the invention can be also applied to, for example, a base substance for a thermal head.

The invention provides (an excellent effect in the recording head and the recording apparatus of the system for discharging the ink by using the heat energy which is presented by the applicant of the present invention, particularly, among the ink jet recording system.

As typical construction and principle it is preferable to execute the recording by using the fundamental principle disclosed in, for example, the specifications of U.S. Pat. Nos. 4,723,129 and 4,740,796. Such a method can be applied to any of what are called an on-demand type and a continuous type. Particularly, in the case of the on-demand type, at least one driving signal which corresponds to the recording information and gives a rapid temperature increase exceeding nucleate boiling is applied to the electrothermal converting element arranged in correspondence to a sheet or liquid path in which the liquid (ink) has been held. Such a method is effective because by the supply of the driving signal, a heat energy is generated in the electrothermal converting element, film boiling is caused on the heat operating surface of the recording head, and a bubble in the liquid (ink) can be formed in response to the driving signal in a one-to-one correspondence relational manner. The liquid (ink) is discharged through a discharge port by the growth and contraction of the bubble, thereby forming at least one liquid droplet. Assuming that the driving signal has a pulse-like shape, the growth and contraction of the bubble is instantaneously and properly executed. Therefore, since the discharge of the liquid (ink) having, particularly, a high response speed can be accomplished, such a method is more preferable. As a pulse-shaped driving signal, it is suitable to use the signal as disclosed in the specifications of U.S. Pat. Nos. 4,463,359 and 4,345,262. If the conditions disclosed in the specification of U.S. Pat. No. 4,313,124 regarding a temperature increase rate of the heat operating surface are used, the further excellent recording can be executed.

As a construction of the recording head, besides the construction of the combination of the discharge ports, the liquid path, and the electrothermal converting elements (rectilinear liquid flow path or right-angled liquid flow path), the invention also incorporates the construction in which the recording head is arranged in a region where the heat operating unit is bent as disclosed in the specification of U.S. Pat. No. 4,558,333 or the construction as disclosed in the specification of U.S. Pat. No. 4,459,600. In addition, the invention is also effectively embodied by using the construction in which a slit which is common to a plurality of electrothermal converting elements is used as a discharging unit of the electrothermal converting elements as disclosed in Japanese Patent Application Laid-Open No. S59-123670 or the construction in which an opening for absorbing a pressure wave of the heat energy is used as a discharging unit as disclosed in Japanese Patent Application Laid-Open No. S59-138461.

Further, as a recording head of a full-line type having a length corresponding to a width of the maximum recording medium which is used for recording by the recording apparatus, it is possible to use a construction in which such a length is satisfied by a combination of a plurality of recording heads or either a construction of a single recording head which is integratedly formed as disclosed in the above specifications. In any of the above cases, the further excellent effects can be obtained according to the invention.

<Modifications of the Ink Jet Recording Head>

Figure 12:
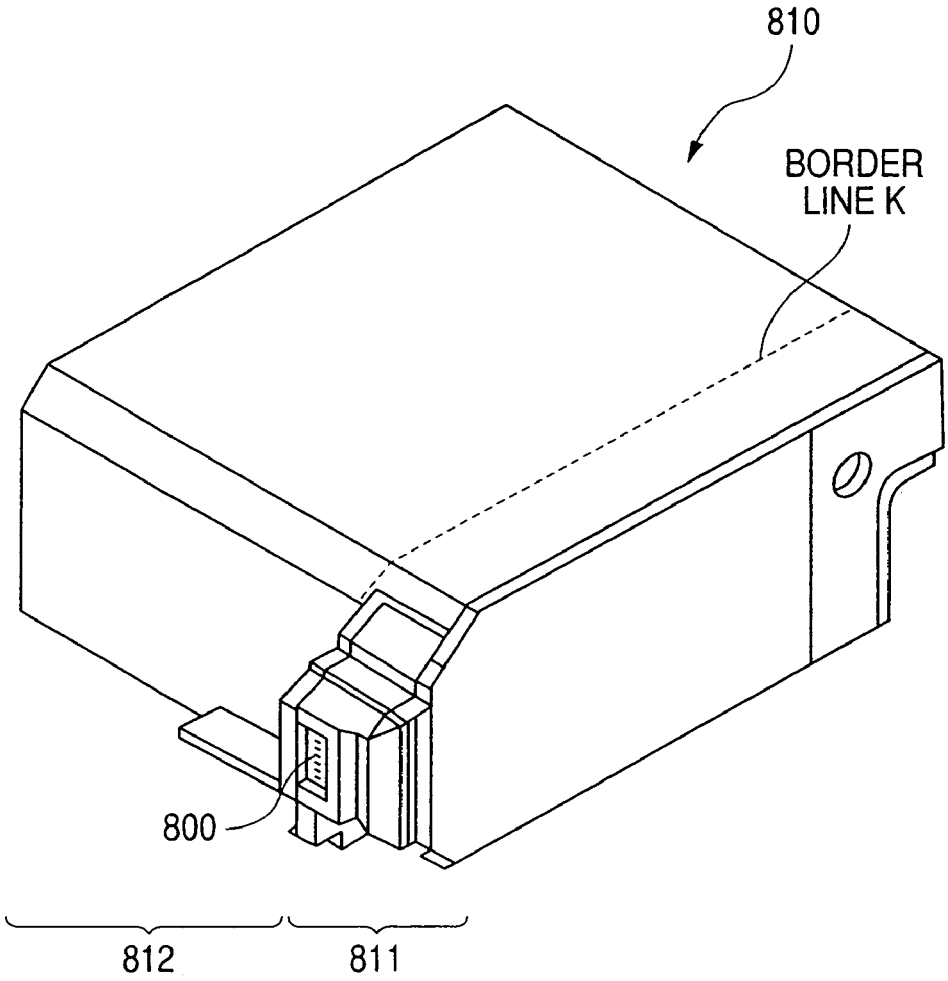
FIG. 12 is a perspective view showing an ink jet recording head according to another embodiment.

As shown in FIG. 12, the ink jet recording head 810 according to a modification of the invention comprises: a recording head unit 811 having a plurality of discharge ports 800; and an ink tank 812 for holding ink to be supplied to the recording head unit 811. The ink tank 812 is detachably attached to the recording head unit 811 along a border line K. The ink jet recording head 810 is equipped with an electric contact (not shown) for receiving an electric signal from the carriage side when the head is mounted onto the recording apparatus shown in FIG. 10. The heater is driven by the electric signal. Fibrous or porous ink absorbers are enclosed in the ink tank 812 in order to hold the ink. The ink is held by the ink absorbers.

The recording head unit 811 and the ink tank 812 of the ink jet recording head 810 can be integratedly constructed.

The invention can be also applied to many variations and modifications of the foregoing embodiments without departing from the spirit and scope of the invention.

The invention can be also applied to a system constructed by a plurality of apparatuses (for example, a host computer, an interface apparatus, a reader, a printer, etc.) or an apparatus comprising one equipment (for example, a copying apparatus, a facsimile apparatus, etc.).

This application claims priority from Japanese Patent Application No. 2004-172532 filed Jun. 10, 2004, which is hereby incorporated by reference herein.

What is claimed is:

1. A recording head comprising:

a plurality of recording elements connected to a first power source;

a switching element which is serially connected to each of said recording elements and independently drives each of said recording elements by supplying a current thereto; and a voltage generating circuit for supplying a voltage for a control signal for controlling said switching element, wherein said voltage generating circuit has a first current-voltage conversion circuit connected to a predetermined electric potential, a first reference voltage which is generated by supplying a constant current to said first current-voltage conversion circuit or a voltage correlated to said first reference voltage is set as a control voltage, and an output voltage is determined by inputting said control voltage to a first transistor, wherein said voltage generating circuit further has a voltage control current source which is constructed by using a second transistor connected to said first power source and supplies said constant current, said voltage control current source is constructed so as to be controlled by an output voltage from a second current-voltage conversion circuit constructed by using a third transistor connected to said first power source, and a current which is inputted to said second current-voltage conversion circuit is correlated to an output current from a third voltage-current conversion circuit for generating a current on the basis of a second reference voltage between a voltage of a second power source and a grounding potential.

2. A head according to claim 1, wherein said second reference voltage is generated by a second resistance element and a diode which are serially connected between said second power source and the grounding potential, one terminal of said second resistance element is connected to said second power source and the other terminal is connected to an anode of said diode, and a cathode of said diode is connected to said grounding potential.

3. A head according to claim 2, wherein said second resistance element has negative temperature characteristics.

4. A head according to claim 1, wherein said second reference voltage is generated by a band gap reference circuit connected between said second power source and the grounding potential.

5. A head according to claim 1, wherein said voltage control current source has error current eliminating means for eliminating an error current which is caused by the Early effect of said second transistor.

6. A head according to claim 5, wherein said error current eliminating means includes:

error current detecting means for detecting said error current included in an output current which is outputted from said second transistor; and current arithmetic operating means for subtracting said error current from said output current.

* * * * *